US006977476B2

(12) United States Patent
Koch

(10) Patent No.: US 6,977,476 B2
(45) Date of Patent: Dec. 20, 2005

(54) WORK TABLE

(76) Inventor: Walter Koch, Schulgasse 16, Schwanberg (AT) A-8541

( * ) Notice: Subject to any disclaimer, the term of this patent is extended or adjusted under 35 U.S.C. 154(b) by 0 days.

(21) Appl. No.: 10/504,184

(22) PCT Filed: Feb. 11, 2003

(86) PCT No.: PCT/AT03/00039

§ 371 (c)(1),
(2), (4) Date: Aug. 11, 2004

(87) PCT Pub. No.: WO03/071897

PCT Pub. Date: Sep. 4, 2003

(65) Prior Publication Data

US 2005/0082997 A1 Apr. 21, 2005

(30) Foreign Application Priority Data

Feb. 26, 2002 (AT) ..... A 284/2002

(51) Int. Cl.[7] ..... H02P 1/00
(52) U.S. Cl. ..... 318/280; 318/469; 318/453
(58) Field of Search ..... 318/280, 469, 318/453, 454, 471, 447, 452, 256, 264, 468, 318/266

(56) References Cited

U.S. PATENT DOCUMENTS 4,394,605 A * 7/1983 Terazawa ..... 315/280
5,723,959 A 3/1998 Iwata et al.

FOREIGN PATENT DOCUMENTS

EP 1 038 470 9/2000

* cited by examiner

*Primary Examiner*—Karen Masih
(74) *Attorney, Agent, or Firm*—Collard & Roe, PC.

(57) ABSTRACT

A work table is described, having a frame (2) which is adjustable especially with respect to its height and for the adjustment of which at least one electric motor (4) with a control device (7) is provided. In order to provide simple constructional conditions it is proposed that the control device (7) which is connected to transducer (10) for the motor load reverses the direction of rotation of the electric motor (4) depending on the determined variable and/or change of the motor load and cuts off the same after a thus caused reverse rotation.

3 Claims, 1 Drawing Sheet

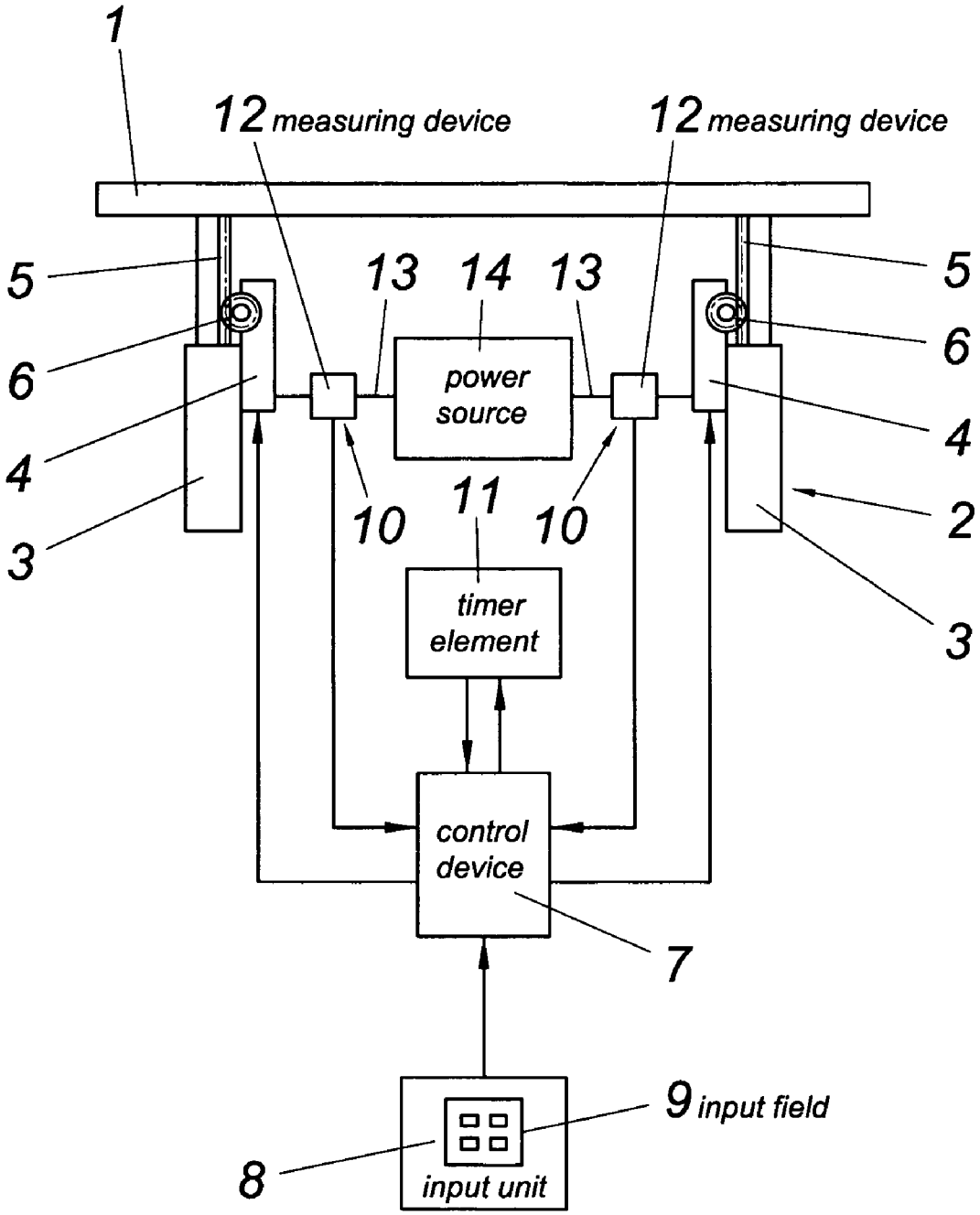
1
12 measuring device
12 measuring device
5
5
13
14
13
6
6
power source
4
4
10
11
10
2
3
3
timer element
control device
7
9 input field
8
input unit

WORK TABLE

CROSS REFERENCE TO RELATED APPLICATIONS

Applicant claims priority under 35 U.S.C. §119 of Austrian Application No. A 284/2002 filed on Feb. 26, 2002. Applicant also claims priority under 35 U.S.C. §365 of PCT/AT03/00039 filed on Feb. 11, 2003. The international application under PCT article 21(2) was not published in English.

FIELD OF THE INVENTION

The invention relates to a work table with a frame which is adjustable especially with respect to its height and for the adjustment of which at least one electric motor with a control device is provided.

DESCRIPTION OF THE PRIOR ART

In order to ensure favorable ergonomic conditions in the region of a workplace, e.g. at a work table for example, it is known to provide work tables with a frame which is adjustable especially with respect to its height. In order to simplify said height adjustment of work tables, electric motors are used which can be actuated via a control device. An electric drive leads to the likelihood however that on the occurrence of an obstruction in the region of the adjusting path of the work table, an item placed on the work table or drive parts, said obstruction will not be recognized and will be loaded with a force which is relatively considerable as a result of the electromotive drive, leading to an endangerment of the obstruction, as well as the work table or the item situated on the work table. This applies in particular when body parts represent such obstructions, because in this case there is a relatively high risk of injury.

SUMMARY OF THE INVENTION

The invention is thus based on the object of providing a work table of the kind mentioned above in such a way that obstructions which reach the path of movement of the work table or drive parts are detected in a simple fashion in order to enable the cut-off of the table drive before causing any damage or injuries.

This object is achieved by the invention in such a way that the control device which is connected to a transducer for the motor load reverses the direction of rotation of the electric motor depending on the determined variable and/or change of the motor load and cuts off the same after a thus caused reverse rotation.

Since any obstruction reaching into the path of movement of a work table or its drive parts will increase the motor load, the occurrence of an obstruction can be recognized through a respective monitoring of the motor load, namely independent of the respective local position of the obstruction. For this purpose it is merely necessary to provide a transducer for the load of the motor or motors and to provide a control device with the determined motor loads in order to reverse the direction of rotation of the drive and to cut of the motor or motors after a respective return path in the case of the occurrence of a respective change in the motor load or on exceeding a predetermined load threshold. The reversal of the drive offers the advantage over the mere cut-off of the motors that the obstruction is released again after re-starting the motion and that it can therefore be removed in an unhindered manner from the adjusting region of the work table.

The motor load can be determined in different ways, e.g. through the effective torque which can be detected by means of a pressure sensor provided in the course of the motor support. Especially simple constructional conditions are obtained however when the transducer for the motor load consists of a measuring device for the motor current which changes with the motor load.

For the purpose of the reverse movement of a work table contrary to the predetermined table adjustment, simple constructional conditions are obtained for triggering the motor when the control device cuts off the electric motor after the reversal of the direction of rotation via a timer element which determines the reversal path. The reversal path can be adjusted to the respective conditions through the adjustability of such a timer element.

BRIEF DESCRIPTION OF THE DRAWING

The subject matter of the invention is shown by way of example in the drawing, which shows a work table in accordance with the invention in a schematic block diagram.

DESCRIPTION OF THE PREFERRED EMBODIMENTS

The illustrated embodiment shows a work table with a table board 1 which is carried by a frame 2 comprising telescopic legs 3 for the height adjustment of table board 1. Said telescopic legs 3 are adjustable with the help of electric motors 4 which drive gearwheels 6 combing a toothed rack 5 when the electric motors 4 are triggered accordingly via a control device 7. An input unit 8 is used for the purpose of actuating the illustrated actuating device, which input unit can also be in connection with the control device 7 in a wireless manner and comprises a conventional input field 9 for operating the work table.

In order to recognize obstructions in the region of the adjusting path for the table board 1 or an item placed on the table board 1 and in order to trigger the electric motors 4 via the control device 7 in such a way that when approaching the obstruction neither the obstruction nor the work table or any device positioned on the table board 1 will be damaged, the motor load is detected via transducer 10 and is forwarded to the control device 7, so that as a result of the respective changes in the load it is possible to carry out an intervention in the motor control. The configuration is made in such a way that the electric motors 4 are not only stopped but are also reversed in their direction of rotation in order to revert the table board 1 in order to release the obstruction. For this purpose, following the reversal of the direction of rotation of the electric motors 4, their cut-off is controlled via a timer element 11 which predetermines a preferably adjustable time interval for the motor operation in the opposite direction.

The transducers 10 for the motor load are arranged in the respective embodiment as measuring devices 12 for the respective motor current and interposed in the supply lines 13 between the motors 4 and a power source 14 which can be present in the form of a power unit or a battery for example. On the basis of the motor current which changes with the motor load, an effective monitoring for the unhindered adjustment of the work table is obtained, so that in the case of an occurrence of an obstruction the adjustment of the work table as predetermined by the input device 8 is interrupted and is reversed by an amount which leads to the release of the obstruction approached by the work table or an item placed on the table.

What is claimed is:

1. A work table with a frame which is adjustable especially with respect to its height and for the adjustment of which at least one electric motor with a control device is provided, wherein the control device which is connected to a transducer for the motor load reverses the direction of rotation of the electric motor depending on a change of the motor load and cuts off the same after a thus caused reverse rotation.

2. A work table according to claim 1, wherein the transducer for the motor load consists of a measuring device for the motor current.

3. A work table according to claim 1, wherein the control device cuts off the electric motor via a timer element after the reversal of the direction of rotation.

* * * * *